US005535573A

United States Patent [19]

Focke et al.

[11] Patent Number: 5,535,573

[45] Date of Patent: Jul. 16, 1996

[54] APPARATUS (BLANK UNIT) FOR FEEDING BLANKS TO AN ARTICLE WHICH IS TO BE WRAPPED

[75] Inventors: Heinz Focke; Oskar Balmer, both of Verden, Germany

[73] Assignee: Focke & Co. (GmbH & Co.), Verden, Germany

[21] Appl. No.: 127,457

[22] Filed: Sep. 27, 1993

Related U.S. Application Data

[63] Continuation of Ser. No. 961,859, Oct. 16, 1992, abandoned.

[30] Foreign Application Priority Data

Oct. 19, 1991 [DE] Germany ..... 41 34 647.5

[51] Int. Cl.[6] ..... B65B 11/06; B65B 41/12

[52] U.S. Cl. ..... 53/201; 53/228; 53/389.3; 53/389.5

[58] Field of Search ..... 53/66, 389.5, 228, 53/230, 586, 201, 231, 389.3; 493/478, 479

[56] References Cited

U.S. PATENT DOCUMENTS

| | | | |
|---|---|---|---|
| 2,739,431 | 3/1956 | Griswold et al. | 53/231 |
| 2,930,173 | 3/1960 | Labine . | |
| 3,222,844 | 12/1965 | Smith et al. | 53/228 X |
| 3,269,089 | 8/1966 | Heywood | 53/586 |
| 3,277,630 | 10/1966 | Youngman et al. | 53/228 X |
| 3,385,026 | 5/1968 | Schmermund | 53/228 |
| 3,387,429 | 6/1968 | Peabody | 53/228 |
| 3,996,728 | 12/1976 | Gentili | 53/586 X |
| 4,386,997 | 6/1983 | Molitor et al. | 53/586 X |
| 4,524,658 | 6/1985 | Focke et al. | 53/389.5 X |
| 4,554,777 | 11/1985 | Denk et al. | 53/201 |
| 5,056,294 | 10/1991 | Focke et al. | 53/201 |

FOREIGN PATENT DOCUMENTS

| | | | |
|---|---|---|---|
| 3131687 | 3/1983 | Germany . | |
| 402052 | 2/1932 | United Kingdom | 53/201 |

*Primary Examiner*—Linda B. Johnson

*Attorney, Agent, or Firm*—Sughrue, Mion, Zinn, Macpeak & Seas

[57] ABSTRACT

An apparatus (blank unit) for feeding blanks to an article to be wrapped is disclosed. In the feeding of blanks (13) or of a web of material (14) made from critical packaging materials (thin foils), suction conveyors (32 . . . 37) are used which transport, guide and retain the web of material (14). An optimum guidance of the web of material (14) is ensured when lateral elongated suction conveyors (32, 33) reach below a pack track (15). Additionally, shorter suction conveyors (34 . . . 37) are disposed above the pack track (15) in the region of the web of material (14). To adjust the blank unit to different widths of the web of material (14), the lateral elongated suction conveyors (32, 33) can be displaced transversely relative to one another. Moreover, individual shorter suction conveyors (34 . . . 37) can be removed. To adapt the apparatus to different heights of the article which is to be wrapped (group of packs 12), the means which are involved in the positioning of the web of material (14) or the blank (13) are vertically adjustable. For this purpose, a support, in this case a housing (17), to which the means are attached, is movable up and down by a spindle mechanism.

5 Claims, 7 Drawing Sheets

71
10
17
64
69
68
14
18
20
21
70
67
25
22
23
65
66
75
73
74
63
11
76
62
63
15
16
72
62

APPARATUS (BLANK UNIT) FOR FEEDING BLANKS TO AN ARTICLE WHICH IS TO BE WRAPPED

This is a Continuation of application Ser. No. 07/961, 859, filed Oct. 16, 1992, and now abandoned.

BACKGROUND OF THE INVENTION

The invention relates to an apparatus (blank unit) for transporting a web of (thin) packaging material, especially of plastic foil, and for severing a blank from the web of material and feeding the blank to a transversely extending pack track on which articles (packs) can be transported in order to be wrapped in the blank, the web of material and the blank being guided to the region of the pack track by guide means, especially transport conveyors (suction conveyors).

Packaging material made from thin (plastic) foils is difficult to handle. When articles are wrapped in blanks, it is a known and conventional procedure to transport and guide the web of material and the severed blanks by suction conveyors until the blank is received by the article which is to be wrapped. The suction conveyors take the form of elongated guide means like those in the invention, which are subjected to negative pressure and which suck in and thus retain the packaging material which rests on a conveying strand. The suction conveyors are driven in the transport direction.

Transporting and guiding critical packaging material is particularly problematic in the manufacture of pack units (bundles) formed from a plurality of small packs. Bundles of paper tissues packs are produced in different sizes, for example with 6, 8, 10 and up to 24 individual packs. The web of material and the blanks which are severed from the web are dimensioned accordingly.

SUMMARY OF THE INVENTION

The invention is directed to measures for the feeding of the web of material and of the blanks which appropriately allow for the different dimensions of the bundles which are to be produced.

The invention is based on the object to design an apparatus of the aforementioned type, namely a blank unit, in such a way that it can be readily and efficiently adjusted to different dimensions of the bundles which are to be produced, such that the web of material and the blanks severed from the web are guided and retained reliably even when their dimensions vary.

To attain this object, the apparatus according to the invention is characterized in that additional guide means (suction conveyors) are disposed between lateral guide means (suction conveyors) and in that these additional guide means end in front of or above the pack track and serve, together with the lateral guide means, for guiding the web of material and the severed blank over their entire width.

In the blank unit according to the invent ion, elongated guide means, namely suction conveyors, are therefore disposed at the longitudinal sides of the web of material and the blanks. These suction conveyors reach below the pack track for the articles which are to be wrapped. These elongated lateral suction conveyors extend laterally past the pack track. Additionally, shorter suction conveyors are disposed in spaced relationship in the region between these lateral suction conveyors. These shorter suction conveyors end above the pack track. The web of material or the blanks are thus retained and guided above the pack track over their entire width by guide means, namely suction conveyors. As a result, it is possible to accurately transport even very wide webs of material without creasing the webs.

According to a further proposal of the invention, the blank unit can be adjusted to different widths of the web of material and the blanks. According to the invention, the number of the suction conveyors which are disposed next to one another can be reduced for this purpose. In particular, the lateral suction conveyors are displaceable relative to one another, that the two longitudinal sides of the web of material and the blanks are always contacted by an elongated suction conveyor in the accurate position. Shorter suction conveyors which are disposed between these elongated suction conveyors can be (partly) removed, so that the positioning of the suction conveyors remains the same, regardless of the width of the web of material, even if there is a smaller number of suction conveyors.

The blank unit is also equipped for an adjustment to different sizes of the packs (bundles) which are to be produced. According to the invention, the blank unit as a whole or the means which are of importance for the different dimensions of the bundles is/are movable up and down for this purpose. As a result, the apparatus can be adapted to the height and/or width of the bundles. According to the invention, the blank unit or its means are attached to a support which can be moved up and down via an adjusting mechanism, preferably a spindle which is driven to rotate.

Further details of the invention relate to the structure of the blank unit, especially to the design and arrangement of the suction conveyors. An exemplary embodiment of the apparatus will be described below in detail with reference to the drawings, in which:

DESCRIPTION OF A PREFERRED EMBODIMENT

Figure 1:
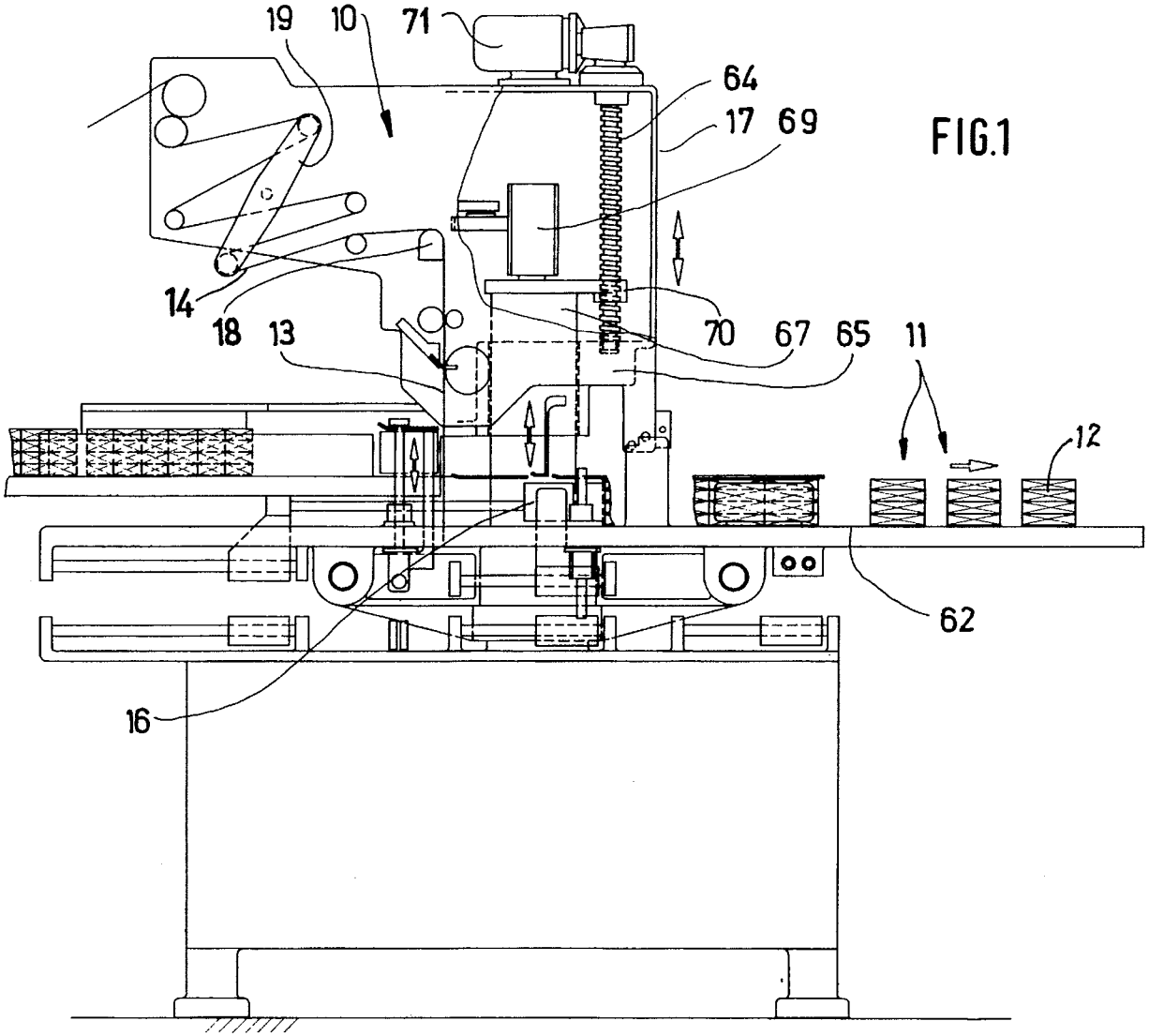
FIG. 1 shows a schematic side view, partly broken away, of a packaging machine for producing bundles.

The illustrated exemplary embodiment of a blank unit 10 is assigned to a packaging machine for the production of large packs, namely bundles 11. Such a bundle 11 comprises a plurality of individual or small packs, namely paper tissue packs 12. These packs are assembled to groups formed from a plurality of superposed layers (see for example FIG. 8). Such a group of paper tissue packs 12 is wrapped in a common blank 13 of a thin (plastic) foil.

To start the packaging process, the blank 13 which is severed from a web of material 14 is held ready in an upright plane. A pack track 15 extends in the transverse direction, namely in the horizontal direction. The article which is to be wrapped, i.e. in the present case the group of paper tissue packs 12, is moved on the pack track by a slide 16 through the plane of the blank 13. As a result, the blank 13 is taken along and is wrapped in a U-shaped manner around the group of the articles which are to be wrapped.

The blank unit 10 is installed above the pack track 15 in an enclosed housing 17. The web of material 14 is drawn from a bobbin (not shown), introduced into the blank unit 10 and, finally, deflected into a vertical transport plane. A stationary, i.e. non-rotating deflecting crossbeam with a rounded deflecting profile serves for deflecting the web. The contact surface of the web of material 14 on the deflecting crossbeam 18 at the same time serves as a breaking surface for the web of material when the latter is stopped temporarily.

Deflecting rollers and a reel 19 for compensating variations of the movements of the continuously advanced web of material 14 are located upstream of the deflecting crossbeam 18.

Drawing rollers 20, 21 are disposed in the region of the vertical conveying path of the web of material. These drawing rollers effect the controlled feed of the web of material to a severing unit 22. The drawing rollers 20, 21 are driven, particularly at changing speeds, including a short phase of standstill.

The severing unit 22 comprises a knife roller 23 which rotates at a continuous speed and includes a severing knife 24 and a stationary counter-knife 25. The blank 13 is severed from the following web of material 14 in the region of the severing knife 24 and counter-knife When the severing cut is applied, the web of material or the blank rest against the periphery of the knife roller 23. For this purpose, a deflecting bar 26 is disposed upstream of the knife roller 23 in the conveying direction. The web of material 14 or the blank 13 is retained on the shell surface of the knife roller 23 by a row of suction bores 27 which extends axis-parallel. These suction bores are connected to a suction line 28 within the knife roller 23 in a conventional manner. The suction bores 27 are located behind the severing knife 24 in the conveying direction, so that the leading end of the web of material 14 which is formed after the severance of the blank 13 is fixed reliably on the periphery of the knife roller 23.

The web of material 14 or the blank 13 are retained in the region of the severing unit 22 and below the severing unit by special guide means, so that the blank 13 is not creased or deformed in any other undesirable way. The guide means used for this purpose are upright suction conveyors. Each suction conveyor is formed from an endless suction belt 29. This suction belt is permeable to air, especially by means of holes. The web of material 14 or the blank 13 rests on a conveying strand 30 of the suction belts 29. A stationary vacuum source, for example a suction chamber 31, is formed at the opposite side. The conveying strand 30 rests against this vacuum source which is open towards this conveying strand 30.

In the illustrated exemplary embodiment, it is ensured that the web of material 14 and the blank 13 are guided and supported over their entire width. For this purpose, elongated upright suction conveyors 32, 33 contact the lateral longitudinal edges of the web of material 14 or the blank 13. These long suction conveyors 32, 33 extend laterally next to the pack track 15 and reach below the pack track, such that the web of material 14 is laterally retained by these suction conveyors 32, 33 until it reaches the final position.

Additionally, a plurality of shorter suction conveyors 34, 35, 36, 37 are disposed in the region between the lateral suction conveyors 32 and 33. These shorter suction conveyors 34–37 extend only in the region above the pack track 15. As a result, a particularly effective guidance of the web of material is ensured in this region.

The suction conveyors 32–37 are guided over a common deflecting means with their upper ends, namely over a driving roller 38. This driving roller extends in the transverse direction and is mounted rotatably with its ends in side plates 39, 40 of a machine frame. The driving roller 38 is driven, in particular in coordination with the working cycle of the machine or the rotating movement of the knife roller 23. In the illustrated exemplary embodiment, the upper end of the suction conveyors 32–37 is bent, so that a leg 41 is formed which is upwardly inclined. As a result, the driving roller 38 which forms the upper end of the legs 41 is offset relative to the main portion of the suction conveyors 32–37.

A stationary guide member for the conveying strand 30 of the suction conveyors 32–37 is located in a region adjacent to the knife roller 23 between the strands of the suction belts 29. This guide member is formed from a continuous crossbeam 42 which extends transversely. The ends of the crossbeam 42 are mounted, in the present case on lateral brackets 43, 44. A holding piece 45 is assigned to each suction conveyor 32–37 and is releasably connected to the crossbeam 42. On the side which faces the conveying strand 30, the holding piece 45 is designed in such a way that the suction belts 29 are guided to contact and slide along the holding piece 45 and are deflected into the leg 41 at the level of the knife roller 23. The holding pieces 45 are provided with a recess 46 on their side which is located opposite the conveying strand 30. The transversely extending crossbeam 42 fits in this recess.

An increased suction force is exerted on the suction belts 29 in the region of the holding piece 45. For this purpose, a suction orifice 47 which is open towards the suction belt 29 is formed in the region of the deflection., i.e. in the region of the smallest distance between the suction conveyors 32–37 and the shell surface of the knife roller 23.

A suction chamber 48 which extends over a relatively long distance in the conveying direction is located at a distance below the suction orifice 47. Suction orifice 47 and suction chamber 48 are connected to a vacuum source. For this purpose, transversely directed suction bores 49, 50 are connected to the suction orifice 47 and the suction chamber 48, respectively. These suction bores 49, 50 open out into respective associated suction channels 51 and 52 in the crossbeam 42. The suction channels 51, 52 extend in the longitudinal direction of the crossbeam 42 and up to the ends thereof. As is evident from FIG. 8, portions of the suction channels 51, 52 are disposed to extend approximately to the center of the crossbeam 42. Vacuum lines (not shown) adjoin the suction channels 51, 52 at the lateral ends.

Figure 5:
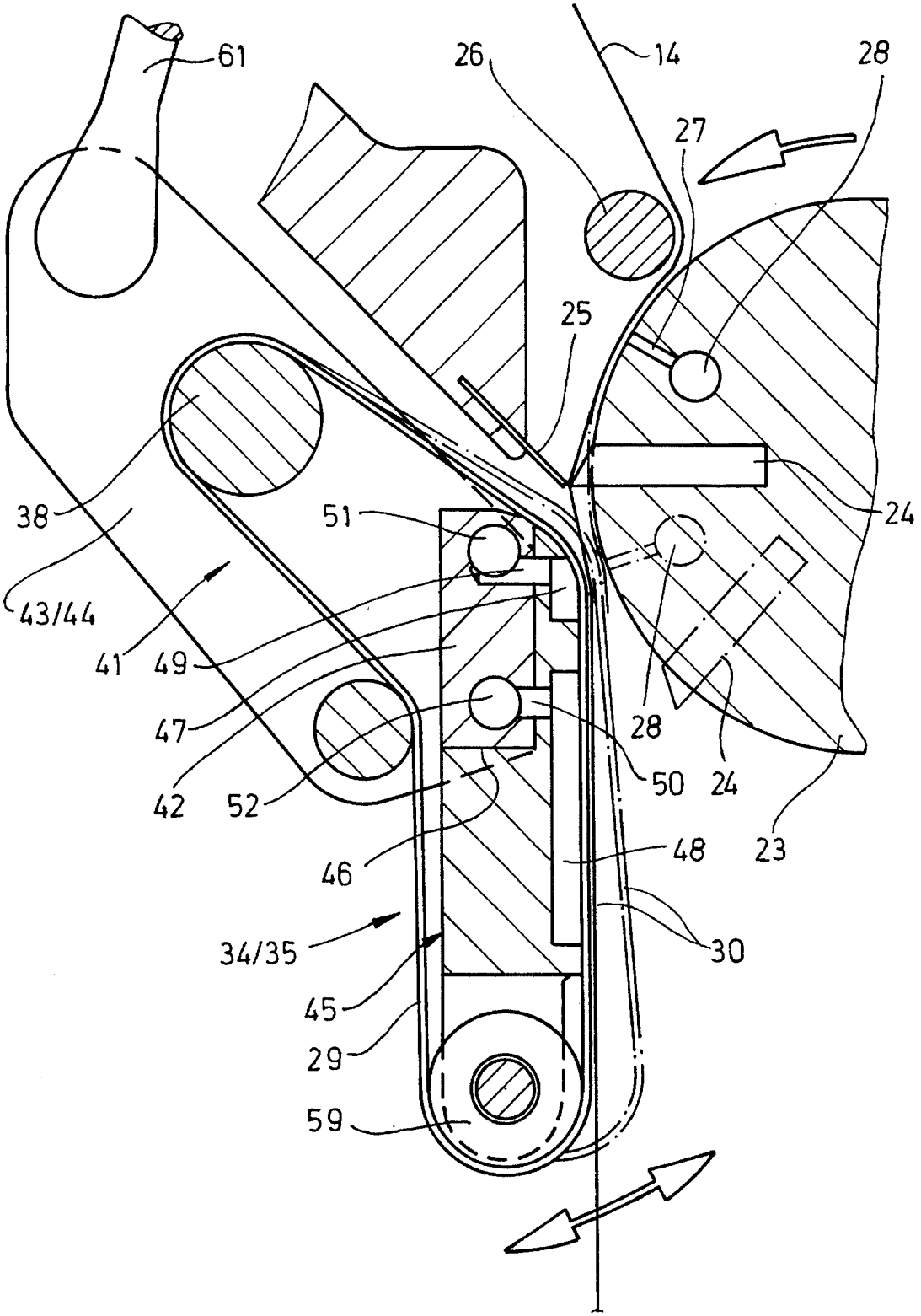
FIG. 5 shows a vertical section of an (upper) portion of a severing unit with guide means, on a greatly enlarged scale.

In their normal position, the suction conveyors 32–37 are located a small distance away from the shell surface of the knife roller 23 (position indicated by solid lines in FIG. 5). After a severing cut has been applied, the conveying end of the web of material 14 which is formed is to be received by the suction conveyors 32–37 in the region of the deflection leading into the leg 41. For this purpose, the suction conveyors 32–37 are, as a whole or partially, moved temporarily against the shell surface of the knife roller 23. In the case of the elongated suction conveyors 32, 33, the upper part is moved together with the leg 41 and the holding piece 45. The shorter suction conveyors 34–37 are moved as a whole until they contact the knife roller 23. The movement takes place after the severing cut is applied, when the knife roller has reached the position illustrated by dot-dash lines in FIG. 5. The leading end of the web of material 14 still rests against the periphery of the knife roller. The suction conveyors 32–37 now receive the leading end of the web of material 14 and the suction air in the region of the suction bores 27 of the knife roller 23 is cut off. After the suction conveyors 32,37 have received the web of material 14, they return to their normal position (see also FIGS. 6 and 7).

Figure 6:
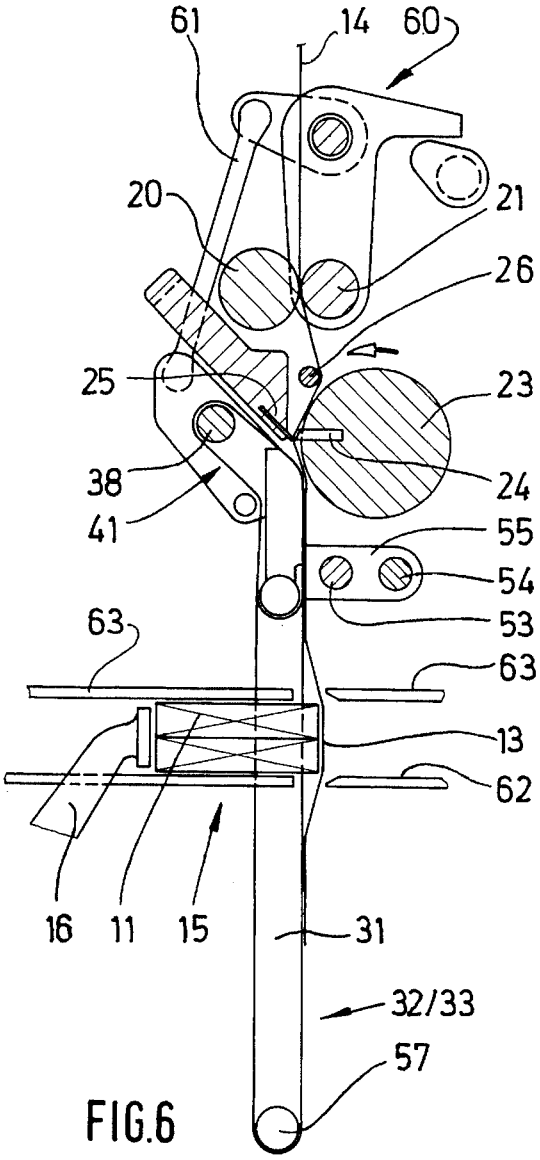
FIG. 6 shows a vertical section of the transport and guide means of the blank unit, taken on the line VI—VI of FIG. 3.
Figure 7:
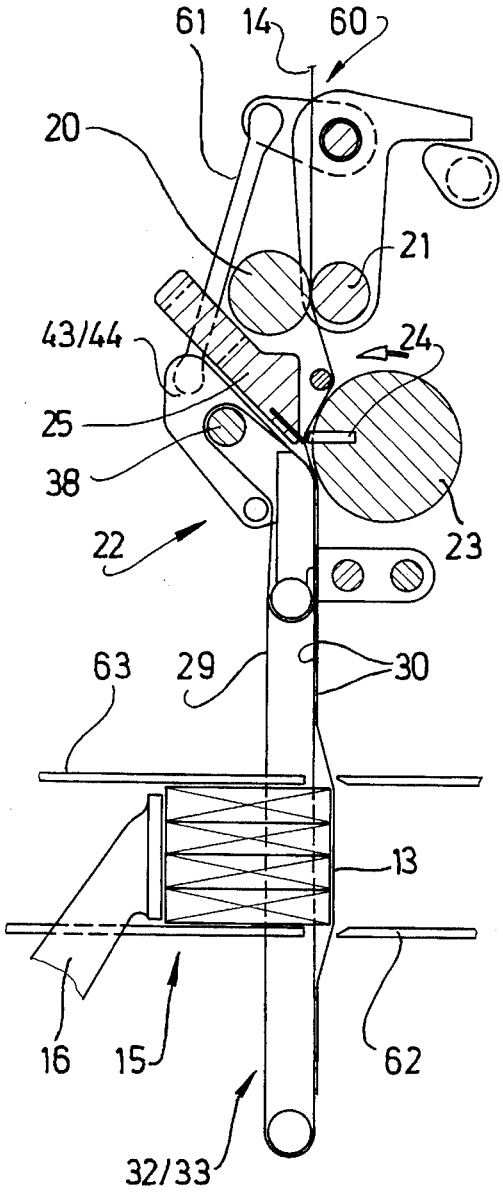
FIG. 7 is a representation corresponding to FIG. 6, showing a different relative position.

The sequence of operations is defined such that the web of material 14 is moved to the final position at a speed which is as high as possible (FIG. 6 and FIG. 7). Then, the web of material 14 is stopped. The blank 13 is severed from the web and is received by the group of articles immediately after the severing cut (FIG. 6 and FIG. 7). Now, the blank 13 is drawn off very rapidly.

Now, the web of material 14 is again set into motion, in particular at first only at a conveying speed which corresponds to the peripheral speed of the continuously rotating knife roller and then at a considerably higher speed.

The blank unit 10 can be adapted to different dimensions of the bundle 11. Bundles of paper tissue packs 12 may have many different dimensions, specifically with regard to both the dimension transverse to the web of material 14 (width of the web of material) as well as the height. In the case of bundles having a small width (solid lines in FIG. 8), a web of material 14 with an appropriately smaller width is fed to the bundle. In the case of larger bundles, the web of material 14 has an appropriately greater width (dot-dash lines in FIG. 8).

Because the web of material 14 is always to be guided in the region of the longitudinal edges, the elongated suction conveyors 32, 33 are arranged displaceably. In the present exemplary embodiment, one elongated suction conveyor is stationary (suction conveyor 32 on the right hand side in FIG. 8) The other one is displaceable in order to be adjusted to the width of the web of material 14.

For this purpose, the suction conveyors 32, 33 are mounted displaceably on a transversely directed supporting means. In the present case, this supporting means comprises two supporting rods 53, 54 which extend in parallel. A laterally projecting supporting leg 55 of the suction chamber 31 is mounted on the two supporting rods 53, 54. A tightening screw 56 locks the supporting leg 55 and thereby the suction conveyor 32, 33 in the desired position. During displacement, the suction belt 29 slides on the common driving roller 38. Each suction conveyor 32, 33 is associated with a single deflecting roller 57 which serves as a lower deflection of the suction belts 29. In the present case, this deflecting roller is mounted displaceably against the bias of a compression spring 58 in order to compensate variations of the length of the suction belt 29 during the movements of the upper part of the suction conveyors 32, 33.

The shorter suction conveyors 34 . . . 37 can be displaced in the transverse direction as well. They are held by the holding piece 45 which is connected releasably to the crossbeam 42, for example by screws which are not shown. In this case, a deflecting roller 59 is disposed at the lower end of the holding piece 45.

Figure 8:
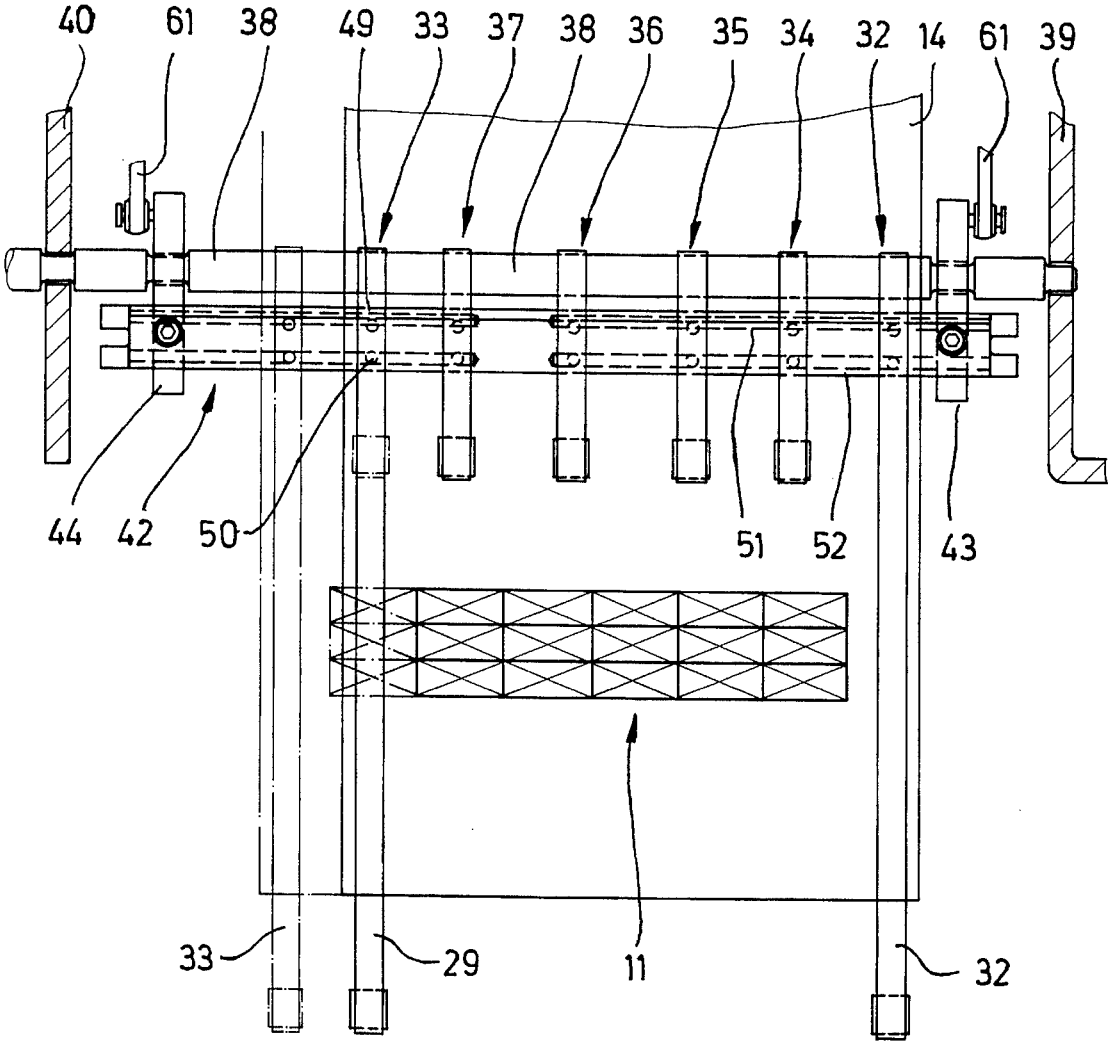
FIG. 8 is a view or vertical section similar to the representation of FIG. 3, showing different positions of guide means.

When a web of material 14 with a small width is used, it is of advantage to remove one or more of the shorter suction conveyors 34 : . . 37. For this purpose, the holding piece 45 is released from the crossbeam 42 and removed. The suction belt 29 which is now free can be removed laterally or mounted in this place. As a result, the number of short suction conveyors 34–37 which is in operation always corresponds to the width of the web of material 14. The suction bores 49, 50 are disposed in the crossbeam 42 in such a way that they correspond to a certain given position of the holding pieces 45 (FIG. 8).

The aforedescribed movements of the suction conveyors 32–37 for a take-over of the leading end of a web of material 14 are carried out by the brackets 43, 44. A pivoting movement of the brackets is transferred to the crossbeam and thereby to the suction conveyors 32–37. The brackets 43, 44 are operated by a crank 60 with a connecting rod 61.

A further way of adjusting the apparatus to different formats relates to different heights of the article or group of paper tissue packs 12 which is to be wrapped (FIG. 6, on the one hand, and FIG. 7, on the other hand). A lower conveying plane 62 of the articles or packs 12 which are to wrapped is stationary and invariable. An upper guide 63 can be adjusted to changing heights of the bundles 11. Additionally, the position of the blank 13 relative to the pack track 15 has to be changed accordingly. In the illustrated blank unit 10, this is attained by a vertical adjustability of the blank unit 10 as a whole or at least of the means which are involved in providing the blank 13.

In the present exemplary embodiment, a spindle mechanism is provided for this purpose. An upright spindle 64 is mounted within the housing 11. This spindle bears rotatably in a supporting part 65 with its lower end. The supporting part 65 forms part of the housing 17, namely a lower end part thereof, and is moved up and down with the housing.

The housing 17 is mounted with a (sliding) guide 66 on a base 67 in a vertically movable manner. This base is stationary and connected to the machine frame of the packaging machine. A stationary driving unit 69 for the means of the blank unit 10 is mounted on a platform 68 on the upper end of the base 67. A lateral projection 70 of the platform 68 takes the form of a spindle nut for the spindle 64. A motor 71 for driving the spindle 64 is located on the top side of the housing 17, namely on the top wall. When the spindle is rotated, the housing 17, including the spindle 64 and the supporting part 65, is moved up or down relative to the base 67 or the projection 70.

Figure 2:
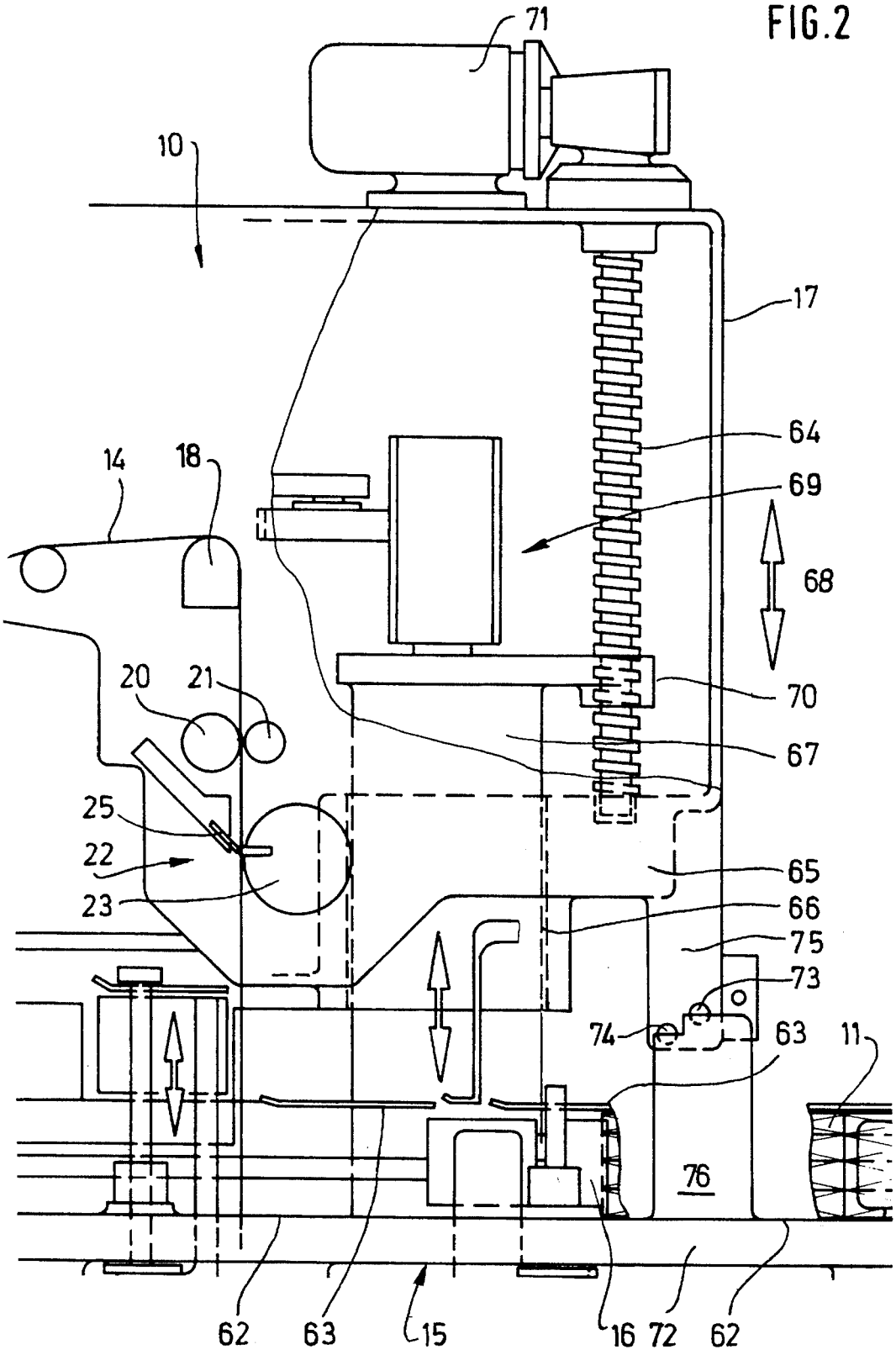
FIG. 2 shows a detail view of the blank unit of the packaging machine of FIG. 1, on an enlarged scale.
Figure 3:
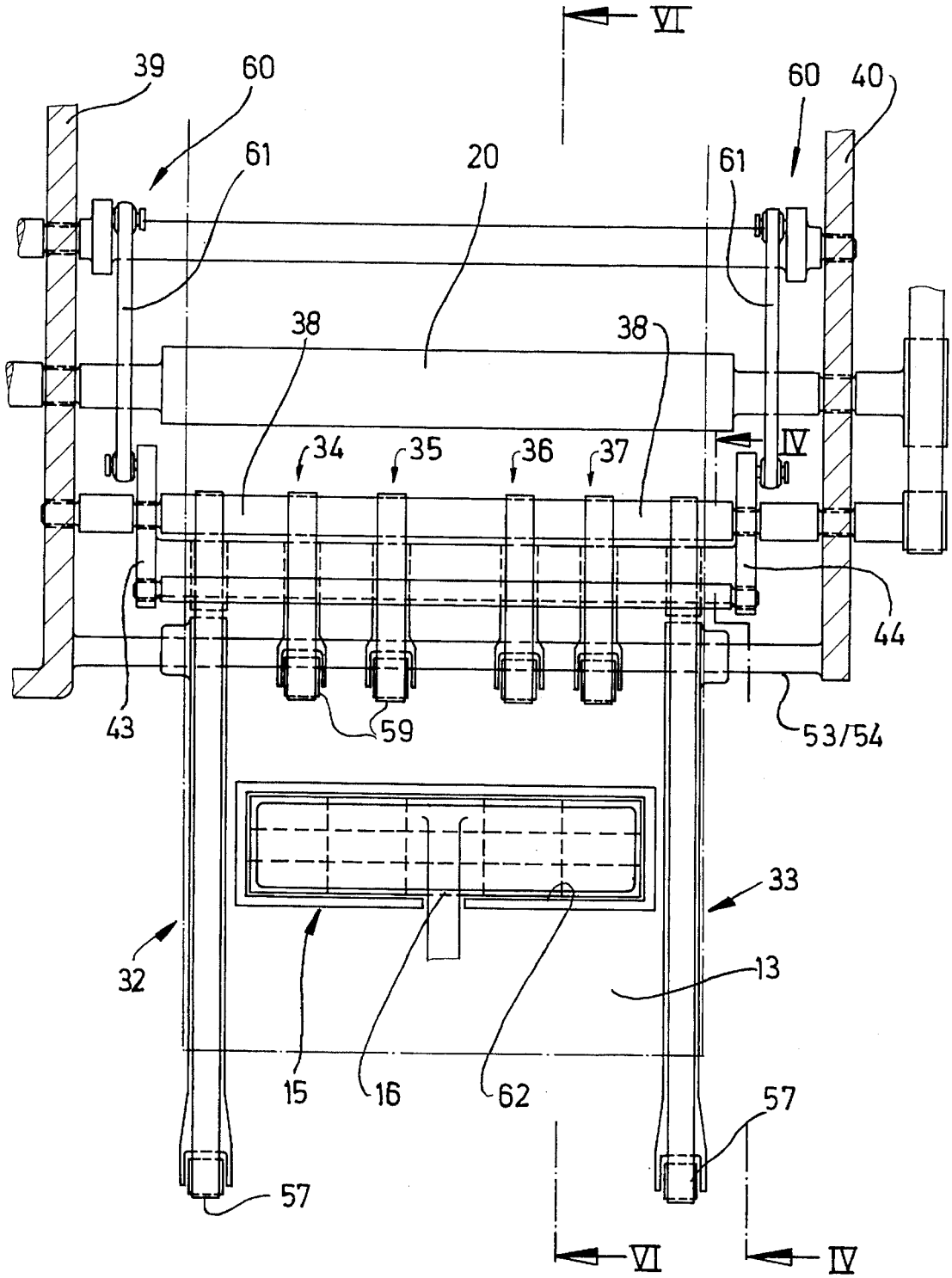
FIG. 3 shows a transverse view of conveying or guide means of the blank unit, on an even further enlarged scale.
Figure 4:
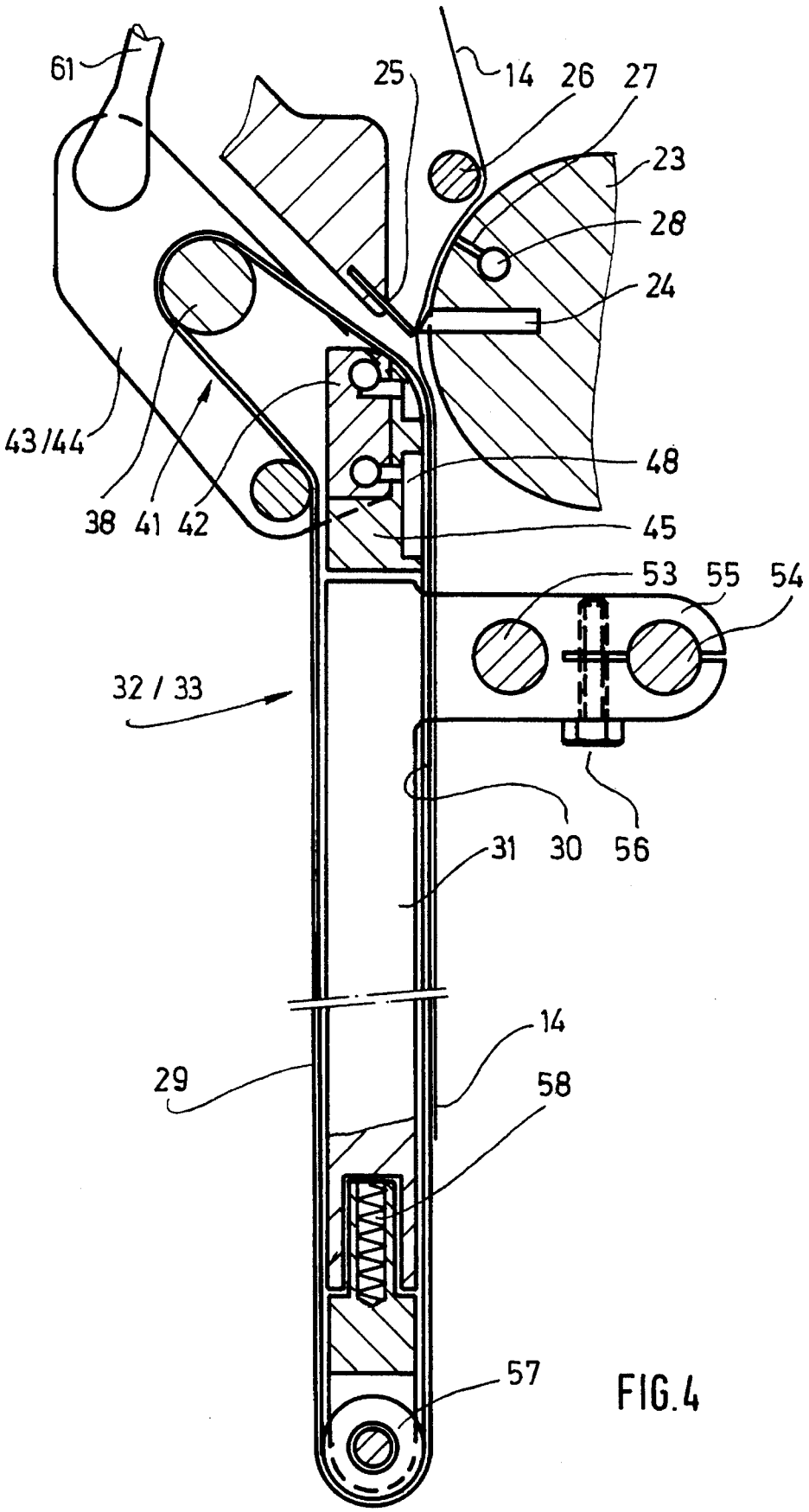
FIG. 4 shows a cross section or vertical section through the guide means taken on the line IV—IV of FIG. 3.

In the present exemplary embodiment, a group of format-dependent packaging means is exchanged when the format of the packs (bundles 11) which are to be produced is changed. Most of these are folding means which are disposed on a main plate 72 which forms the conveying plane 62. The main plate 72 can be moved out of the working position shown in FIG. 1 and FIG. 2 together with the packaging means which are to be exchanged and can be replaced with a set of appropriate packaging means for a different format of the bundles 11. This change of format is subject matter of DE-A-39 07 615.6 corresponding to U.S. Pat. No. 5,056,294.

The blank unit 10 is used for every format. To change the format, the housing 17 with the blank unit 10 is lifted at first. After the format-dependent packaging means have been exchanged, the blank unit 10 is moved downwards to the appropriate position for the respective format. This working position of the blank unit 10 is determined by tracer means which are in connection with, on the one hand, the exchangeable packaging means and, on the other hand, the housing 10.

In the present exemplary embodiment, (two) sensors 73 and 74 are for this purpose attached to the supporting part 65 of the housing 17 with a holder 75. These sensors 73 and 74 are proximity switches which interact with a metallic object without any contact. In the present case, this metallic object is a tracer lug 76 which is disposed on the top side of the main plate 72 which is to be exchanged. The shape or height of the tracer lug 76 is adapted to the respective format which is to be produced. During the downward movement of the housing 17, the sensors 73, 74 generate a control signal as soon as they reach the upper edge portion of the tracer lug 76. The control signal is transmitted to the motor 71 and acts as a stop signal. The blank unit 10 is thus vertically adjusted automatically in response to the dimensions of the respective bundle 11 which is to be produced.

We claim:

1. An apparatus for producing large bundles (11) by wrapping smaller packs (12) in a blank, said apparatus comprising:

a) a main plate (72) which forms a conveying plane (62) for the packs (12), and which is exchangeable together with format-dependent packaging members;

b) a blank unit (10) which is adjustable to different heights, and which is arranged above the conveying plane (62) in which blanks (13) are severed from a web of material (14) made from packaging material and are fed in the direction of the conveying plane (62);

c) a first tracer means (76), corresponding to the format of a bundle to be produced, connected to the main plate (72);

d) second tracer means (73, 74), movable together with the blank unit (10), and thus being adjustable to different distances from said first tracer means (76); and e) for adjustment to other bundle formats means for moving the blank unit (10) with the second tracer means (73, 74) away from the conveying plane (62), means for exchanging the main plate (72) together with the format-dependent packaging members (76) for a new main plate, format-dependent packaging means and first tracer means, and means for moving the blank unit (10) together with said second tracer means (73, 74) toward the conveying plane (62) until said second tracer means (73, 74) interact with the new first tracer means (76) of the corresponding new main plate after the exchange.

2. The apparatus according to claim 1, wherein:

a) said first tracer means (76) connected to said main plate (72) is a tracer lug which is adapted in height and shape to the format to be produced; and b) said second tracer means (73, 74) are connected to the blank unit (10), and comprise sensors which issue an output signal as a stop signal when reaching an edge region of said the tracer lug (76) for a motor-driven adjustment of the blank unit (10) to different heights.

3. The apparatus according to claim 2, further comprising, for adjusting the blank unit (10) to different heights, a spindle drive having a motor (71) located upstream of the blank unit (10), a spindle (64) which is rotatable by said motor, and a stationary spindle nut, so that, when the spindle is rotated, the blank unit (10) is moved up and down with the motor (71).

4. The apparatus according to claim 1, wherein said packaging members are folding members.

5. The apparatus as claimed in claim 1, wherein said tracer lug (76) has a graded design with two upper edges disposed at different heights, and wherein said sensors (73, 74) are offset from one another in terms of height with respect to said different heights of the two upper edges of said tracer lug (76).

* * * * *